US007866466B2

(12) United States Patent
Rose et al.

(10) Patent No.: US 7,866,466 B2
(45) Date of Patent: Jan. 11, 2011

(54) SLIDE AND SHELL CONTAINER

(75) Inventors: Dirk Rose, Berlin (DE); Lutz Vocke, Berlin (DE)

(73) Assignee: Philip Morris USA Inc., Richmond, VA (US)

( * ) Notice: Subject to any disclaimer, the term of this patent is extended or adjusted under 35 U.S.C. 154(b) by 353 days.

(21) Appl. No.: 11/984,659

(22) Filed: Nov. 20, 2007

(65) Prior Publication Data

US 2008/0149507 A1 Jun. 26, 2008

(30) Foreign Application Priority Data

Nov. 30, 2006 (EP) ..... 06256146

(51) Int. Cl.
*B65D 85/10* (2006.01)
*B65D 85/00* (2006.01)

(52) U.S. Cl. ..... 206/267; 206/273; 206/270; 229/125.125

(58) Field of Classification Search ..... 206/267, 206/265, 270, 271, 273, 274, 817, 815, 242; 229/125.125, 125.12, 87.13, 160.1
See application file for complete search history.

(56) References Cited

U.S. PATENT DOCUMENTS

| | | | | |
|---|---|---|---|---|
| 2,581,944 | A * | 1/1952 | Donnell | 229/125.125 |
| 2,929,542 | A * | 3/1960 | O'Gorman | 206/268 |
| 3,881,599 | A * | 5/1975 | Flaherty | 206/273 |
| 4,534,463 | A * | 8/1985 | Bouchard | 206/267 |
| 5,080,227 | A * | 1/1992 | Focke | 206/273 |
| 2008/0289977 | A1 * | 11/2008 | Ghini et al. | 206/256 |

FOREIGN PATENT DOCUMENTS

| | | |
|---|---|---|
| BE | 409 334 | 6/1935 |
| CH | 473012 A | 5/1969 |
| DE | 199 02 980 | 8/2000 |
| DE | 202 04 334 | 8/2002 |
| GB | 2 115 386 | 9/1983 |
| JP | 2001 278266 | 10/2001 |

OTHER PUBLICATIONS

International Preliminary Report on Patentability dated Jun. 3, 2009 for PCT/IB2007/004342.
European Search Report dated Apr. 13, 2007, issued in EP Application No. 06256146.9-2308.
International Search Report and Written Opinion for PCT/IB2007/004342 dated Jun. 24, 2008.

* cited by examiner

*Primary Examiner*—Mickey Yu
*Assistant Examiner*—Steven A. Reynolds
(74) *Attorney, Agent, or Firm*—Buchanan Ingersoll & Rooney PC

(57) ABSTRACT

A slide and shell container, which finds particular application as a pack for elongate smoking articles such as cigarettes, and which includes an outer shell having a first access opening; and an inner slide having a second access opening. The inner slide is mounted within the outer shell for slidable movement relative thereto between a closed position, in which the second access opening is occluded by the outer shell and the interior of the inner slide is inaccessible, and an open position, in which the second access opening is substantially aligned with the first access opening such that the interior of the inner slide is accessible through the first and second access openings.

12 Claims, 3 Drawing Sheets

SLIDE AND SHELL CONTAINER

CROSS-REFERENCE TO RELATED APPLICATION

This application claims priority under 35 U.S.C. §119 to European Application No. 06256146.9, filed Nov. 30, 2006, the entire content of which is hereby incorporated by reference.

FIELD OF THE INVENTION

The present invention relates to a novel slide and shell container that finds particular application as a pack for elongate smoking articles such as cigarettes.

BACKGROUND

It is known to package smoking articles and other consumer goods in containers comprising an outer shell or sleeve and an inner slide or tray, mounted within the outer shell for slidable movement relative thereto, in which the consumer goods are housed. To remove consumer goods from such containers, a consumer slides the inner slide from an initial position inside the outer shell to an open position, in which the inner slide projects outwardly from the outer shell, in order to partially expose an open end or side of the inner slide through which the consumer goods housed therein may then be removed.

SUMMARY

According to the present invention there is provided a slide and shell container comprising: an outer shell having a first access opening; and an inner slide having a second access opening, the inner slide being mounted within the outer shell for slidable movement relative thereto between a closed position, in which the second access opening is occluded by the outer shell and the interior of the inner slide is inaccessible, and an open position, in which the second access opening is substantially aligned with the first access opening such that the interior of the inner slide is accessible through the first and second access openings.

In contrast to known slide and shell containers, consumer goods housed in the inner slide of slide and shell containers according to the invention are not removed through an opening in a portion of the inner slide that projects outwardly from the outer shell in the open position. In slide and shell containers according to the invention the portion of the inner slide that projects outwardly from the outer shell in the open position is "complete" and so advantageously provides a greater external surface area upon which manufacturer or brand logos, trade marks, slogans and other consumer information may be displayed compared to known slide and shell containers.

In addition, in known slide and shell containers gaps can remain between the open end or side of the inner slide, through which the consumer goods are removed in the open position, and the outer shell in the closed position. Aside from being aesthetically undesirable, such gaps may disadvantageously result in the inadvertent loss of goods from the inner slide of the container. The provision of access openings in the outer shell and inner slide, which are offset relative to one another in the closed position, advantageously ensures that slide and shell containers according to the invention may be fully closed during use.

In a particularly preferred embodiment of the invention, the first access opening is located in an upper end of the outer shell and the second access opening is located in an upper end of the inner slide, the inner slide being mounted in the outer shell for lateral slidable movement relative thereto.

Preferably, the container comprises retention means for preventing removal of the inner slide from the outer shell.

Preferably, the retention means restricts or substantially prevents slidable movement of the inner slide relative to the outer shell beyond the open position.

The retention means may, for example, comprise a flap pivotably mounted on the outer shell and a tab mounted on the inner slide, that cooperate in a known manner during use to prevent slidable movement of the inner slide relative to the outer shell beyond the open position.

Preferably, at least one cut-out or notch is provided along a free edge of the outer shell. More preferably, a pair of opposed cut-outs are provided along opposed parallel free edges of the outer shell. Most preferably, a pair of opposed cut-outs are provided along opposed parallel longitudinal free edges of the outer shell. In use, a consumer may advantageously grasp the inner slide through the one or more cut-outs provided along the free edges of the outer shell in order to slide the inner slide relative to the outer shell from the closed position to the open position.

Alternatively or in addition to the provision of at least one cut-out along a free edge thereof, an aperture or window may be provided in a wall of the outer shell perpendicular to the direction of slidable movement of the inner slide relative to the outer shell in order to facilitate slidable movement of the inner slide from the closed position to the open position by the consumer. Preferably, the aperture is provided in a longitudinal side wall of the outer shell perpendicular to a lateral direction of slidable movement of the inner slide relative to the outer shell. In use, a consumer may push the inner slide through the aperture provided in the wall of the outer shell in the direction of slidable movement in order to slide the inner slide relative to the outer shell from the closed position to the open position.

Preferably, the inner slide houses a plurality of elongate smoking articles. The smoking articles may be, for example, cigarettes, cigars or cigarillos. Preferably, the smoking articles are cigarettes. It will be appreciated that containers according to the invention may be designed to contain different numbers of conventional size, king size, super-king size, slim or super-slim cigarettes through an appropriate choice of the dimensions thereof.

Where the inner slide of a container according to the present invention houses a bundle of cigarettes or other elongate smoking articles, the smoking articles are preferably wrapped in an inner liner of, for example, metal foil or metallised paper.

The outer shell and inner slide of containers according to the invention may be formed from any suitable materials including, but not limited to, cardboard, paperboard, plastic, metal or combinations thereof. Preferably, the outer shell and inner slide are formed from folded laminar blanks, more preferably from folded laminar cardboard blanks.

The external surfaces of the outer shell and inner slide may be printed, embossed, debossed or otherwise embellished (for example, using labels or stickers) with manufacturer or brand logos, trade marks, slogans and other consumer information and indicia.

Containers of elongate smoking articles or other consumer goods according to the invention may be shrink wrapped or otherwise over wrapped with a transparent polymeric film of, for example, polyethylene or polypropylene in a conventional manner. Where containers according to the invention are over wrapped, the over wrapper may include a tear tape.

Preferably, the outer shell and inner slide are of substantially the same shape.

Preferably, the internal dimensions of the outer shell are substantially the same as the external dimensions of the inner slide, so that inner surfaces of the outer shell overlie and abut the outer surfaces of the inner slide in the closed position. In use, frictional forces generated between the outer surfaces of the inner slide and the abutting inner surfaces of the outer shell resist slidable movement of the inner slide relative to the outer shell between the closed position and the open position. This advantageously prevents opening and closing of the container without the application of a positive force by the consumer.

The outer shell and inner slide of containers according to the invention may be substantially rectangular parallepipedal in shape, with right-angled longitudinal and right-angled transverse edges. Alternatively, the outer shell and inner slide may comprise one or more rounded longitudinal edges, rounded transverse edges, bevelled longitudinal edges, bevelled transverse edges or combinations thereof. For example, by scoring in a known manner laminar blanks from which the outer shell and the inner slide of the container are erected, a "rounded-corner" slide and shell container of cigarettes or other smoking articles according to the invention may be produced.

According to the invention there is also provided a blank for forming the outer shell of a slide and shell container according to the invention, the blank comprising: a top wall panel; a front wall panel foldably attached to the top wall panel; a rear wall panel foldably attached to the top wall panel opposite the front wall panel; and an aperture extending across the top wall panel into the front wall panel and the rear wall panel.

BRIEF DESCRIPTION OF THE DRAWINGS

The invention will be further described, by way of example only, with reference to the accompanying drawings, in which.

DETAILED DESCRIPTION

Figure 1:
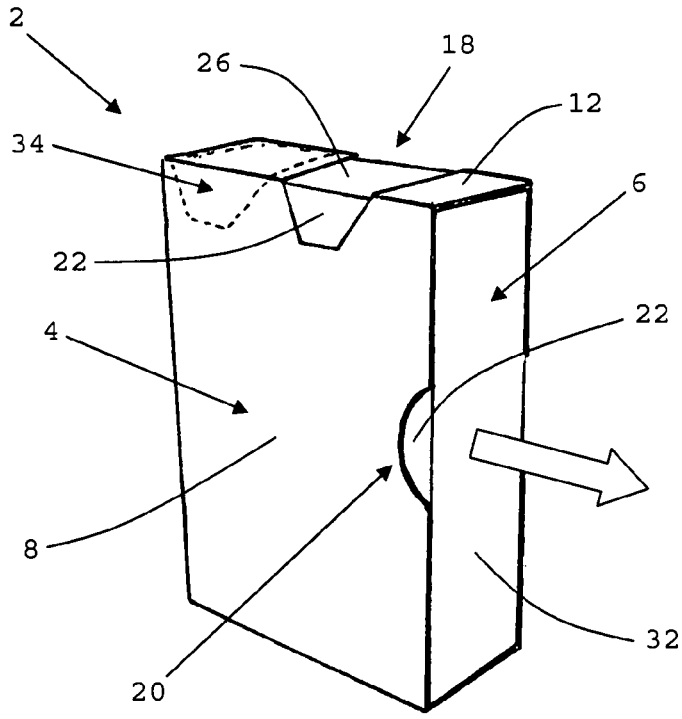
FIG. 1 shows a perspective view of a slide and shell container according to the present invention with the inner slide in the closed position.
Figure 2:
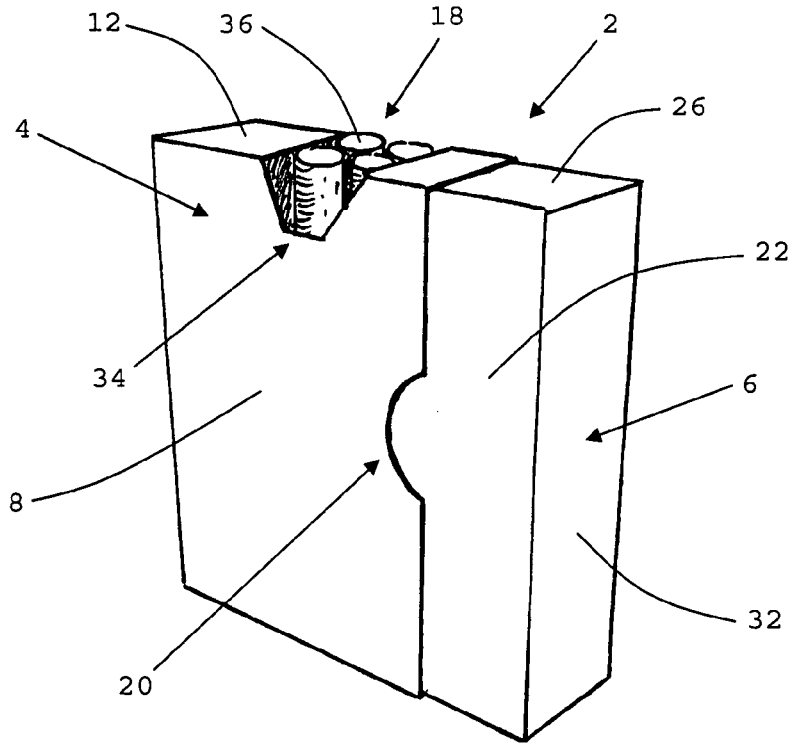
FIG. 2 shows a perspective view of the container of FIG. 1 with inner slide in the open position.

The slide and shell container 2 shown in FIGS. 1 and 2 is a rectangular parallelepiped and generally comprises an outer shell 4 and an inner slide 6, which is mounted within the outer shell 4. The outer shell 4 comprises a front wall 8 and an opposed rear wall 10 (not shown), a top wall 12 and an opposed bottom wall 14 (not shown), which connect the front wall 8 and the rear wall 10 along their upper and lower edges respectively, and a left side wall 16 (not shown), which connects the front wall 8, rear wall 10, top wall 12 and bottom wall 14. The walls 8, 10, 12, 14, 16 of the outer shell 4 thus define an open-sided receptacle within which the inner slide 6 is mounted.

As shown in FIGS. 1 and 2, an access opening 18 is provided in the top wall 12 of the outer shell 4, towards the right hand side thereof. The access opening 18 extends across the top wall 12 into the front wall 8 and rear wall 12 of the outer shell 4. A pair of opposed semi-circular cut-outs 20 are also provided along the right-hand longitudinal free edges of the front wall 8 and rear wall 10 of the outer shell distant from the left side wall 16.

The inner slide 6 has a front wall 22 and an opposed rear wall 24 (not shown), a top wall 26 and an opposed bottom wall 28 (not shown), which connect the front wall 22 and the rear wall 24 along their upper and lower edges respectively, a left side wall 30 (not shown), which connects the left side edges of the front wall 22, rear wall 24 and bottom wall 28, and an opposed right side wall 32, which connects the right side edges of the front wall 22, rear wall 24, top wall 26 and bottom wall 28. An access opening 34 (shown by broken lines in FIG. 1) of substantially the same size and shape as the access opening 18 in the outer shell 4 is provided in the top wall 26 of the inner slide 6, adjacent the left side wall 30 thereof, and extends across the top wall 26 into the front wall 22 and rear wall 24 of the inner slide 6. The walls 22, 24, 26, 28, 30, 32 of the inner slide 6 thus define a receptacle with a partially open top. As shown in FIG. 2, a bundle of elongate smoking articles 36 is housed within the inner slide 6.

The inner slide 6 is mounted in the outer shell 6 for lateral slidable movement between a closed position, shown in FIG. 1, and an open position, shown in FIG. 2.

In the closed position, the inner slide 6 is contained within the outer shell 4, the front wall 8, rear wall 10, top wall 12, bottom wall 14 and left side wall 16 of the outer shell 4 being adjacent to and overlying the front wall 22, rear wall 24, top wall 26, bottom wall 28 and left side wall 30, respectively, of the inner slide 6. As shown in FIG. 1, the access opening 34 in the top wall 26, front wall 22 and rear wall 24 of the inner slide 6 is covered by the corresponding walls of the outer shell 4 in the closed position. The bundle of elongate smoking articles 36 housed within the inner slide 6 is, therefore, inaccessible in the closed position.

The portions of the top wall 26, front wall 22 and rear wall 24 of the inner slide 6 visible through the access opening 18 in the top wall 12, front wall 8 and rear wall 10 of the outer shell 4 in the closed position may be printed with, for example, directions to the consumer regarding opening of the container 2.

In the open position, the left side wall 30 of the inner slide 6 is spaced apart from the left side wall 16 of the outer shell 4 and a portion of the inner slide 6 projects or protrudes outwardly from the outer shell 4 through the open right hand side thereof. As shown in FIG. 2, the relative positions of the inner slide 6 and outer shell 4 in the open position is such that the access opening 34 in the top wall 26, front wall 22 and rear wall 24 of the inner slide 6 is aligned with the access opening 18 in the top wall 12, front wall 8, and rear wall 10, of the outer shell 4, thereby allowing access to the bundle of elongate smoking articles 36 housed within the inner slide 6.

In use, with the inner slide 6 in the closed position, the consumer holds the outer shell 4 of the container 2 in one hand and grasps the front wall 22 and rear wall 24 of the inner slide 6 through the opposed cut-outs 20 provided in the front wall 8 and rear wall 10 of the outer shell 4 with the thumb and forefinger of their other hand. To open the container 2, the consumer pulls the inner slide 6 outwardly away from the outer shell 6, in the direction shown by the block arrow in FIG. 1, in order to slide the inner slide 6 relative to the outer shell 4 from the closed position shown in FIG. 1 to the open position shown in FIG. 2 and so align the access opening 34 in the inner slide 6 with the access opening 18 in the outer shell.

If desired, alternatively or in addition to the pair of opposed semi-circular cut-outs 20 provided along the right-hand longitudinal free edges of the front wall 8 and rear wall 10 thereof, an aperture (not shown) may be provided in the left side wall 16 of the outer shell 4 through which, in use, a consumer may push on the left side wall 30 of the inner slide 6 in order to open the container.

During opening and closing of the container 2, frictional forces generated between the outer surface of the inner slide 6 and the inner surface of the outer shell 4 prevent slidable movement of the inner slide 6 relative to the outer shell 4 until a positive force is applied by the consumer. As described further below, the container 2 further comprises limiting means (not shown in FIGS. 1 and 2) for preventing the slidable movement of the inner slide 6 relative to the outer shell 4 beyond the open position shown in FIG. 2.

Figure 3:
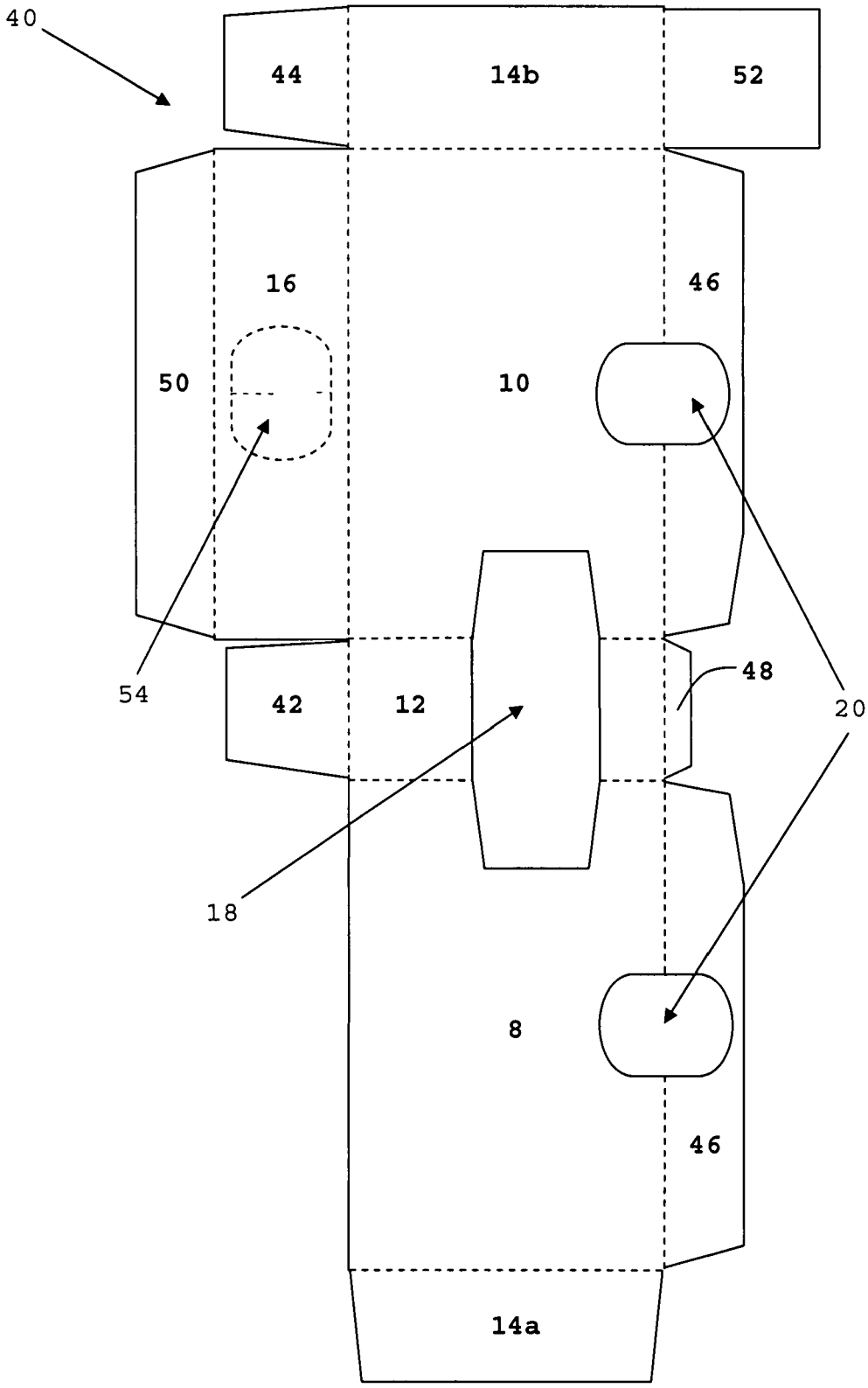
FIG. 3 shows a plan view of a one-piece cardboard blank for forming the outer shell of the container of FIGS. 1 and 2.
Figure 4:
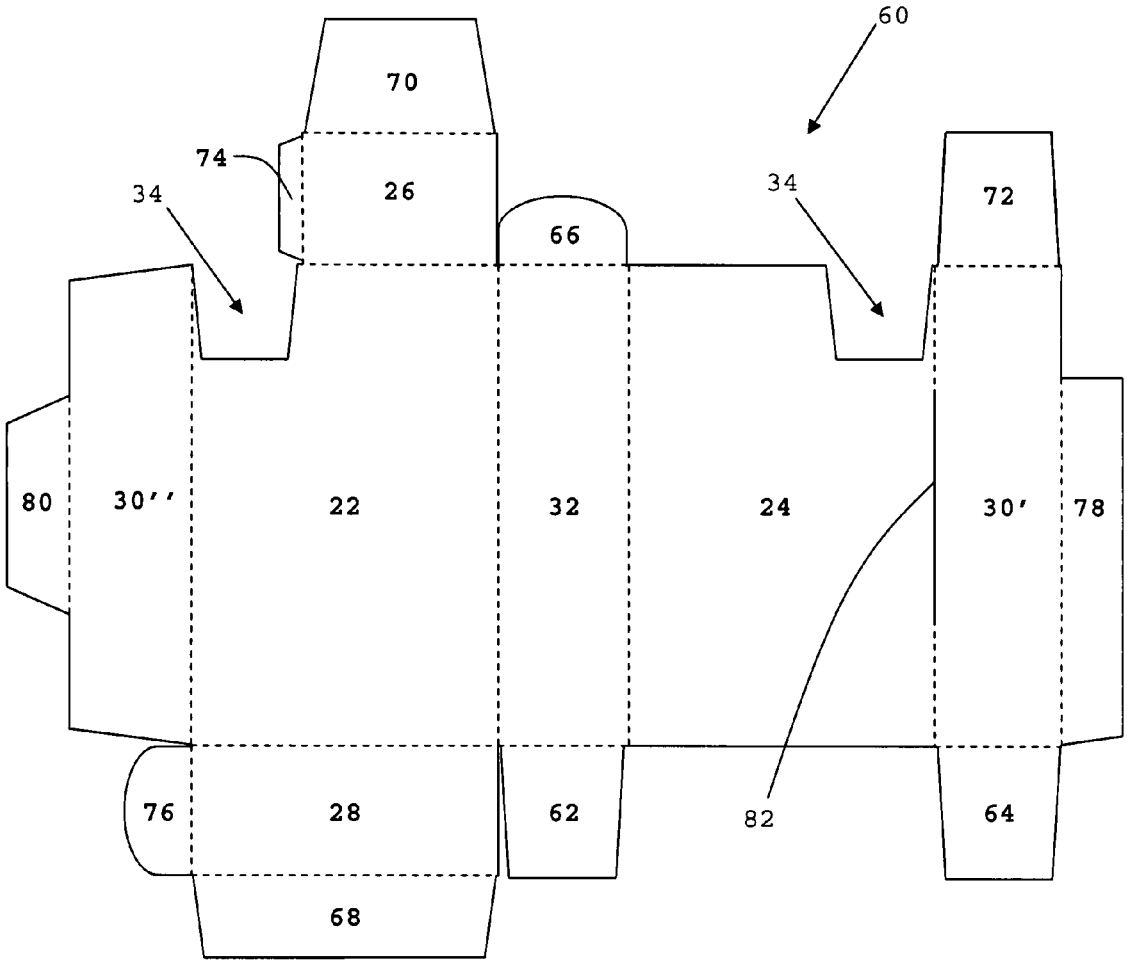
FIG. 4 shows a plan view of a one-piece cardboard blank for forming the inner slide of the container of FIGS. 1 and 2.

Laminar cardboard blanks from which the outer shell 4 and the inner slide 6 of the container 2 of FIGS. 1 and 2 may be formed are shown in FIGS. 3 and 4, respectively. Corresponding reference numerals are used in FIGS. 3 and 4 for elements of the outer shell blank 40 and the inner slide blank 60 that are similar or related to elements of the container 2 of FIGS. 1 and 2 previously described. Each blank 40, 60 includes various panels, flaps and tabs (labelled in bold in FIGS. 3 and 4), which when folded about appropriate score lines (shown in FIGS. 3 and 4 by broken lines) and affixed, with for example adhesive, in a conventional manner, form the required parts of the slide and shell container 2 shown in FIG. 1. The term score line is used to indicate a line formed by, for example, creasing, scoring, perforating, embossing or otherwise compressing, cutting or weakening the blanks 40, 60.

The blank 40 for forming the outer shell 4 of the container 2 shown in FIG. 3 has a front wall panel 8, a rear wall panel 10, a top wall panel 12, an inner bottom wall panel 14*a*, an outer bottom wall panel 14*b*, and a left side wall panel 16, which when folded form the corresponding walls of the outer shell 4. An upper closure tab 42 and a lower closure tab 44 are connected to the left hand edges of the top wall panel 12 and outer bottom wall panel 14*b*, respectively, of the blank 40 along score lines. During erection of the outer shell 4, the upper closure tab 42 and the lower closure tab 44 are folded through 90 degrees about these score lines and affixed to the inner surface of the left side wall panel 16.

As shown in FIG. 3, the blank 40 also includes front wall and rear wall reinforcement flaps 46 and a top wall reinforcement flap 48, which are connected to the corresponding wall panels along score lines. During erection of the outer shell 4, the front wall and rear wall reinforcement flaps 46 and the top wall reinforcement flap 48 are folded through 180 degrees about these score lines and affixed to the inner surface of the front wall panel 8, rear wall panel 10 and top wall panel 12, respectively.

The blank 40 further comprises a closure flap 50, which is connected to the left hand edge of the left side wall panel 16 along a score line, and a retention flap 52, which is connected to the right hand edge of the outer bottom wall panel 14*b* along a score line. During erection of the outer shell 4 from the blank 40, the closure flap 50 is folded through 90 degrees about the score line and affixed to the inner surface of the front wall panel 8 and the retention flap 52 is folded through 180 degrees about the score line so that it rests against the inner surface of the inner bottom wall panel 14*a* in the formed outer shell 4.

The fold lines formed between the front wall reinforcement flap 46, rear wall reinforcement flap 46, top wall reinforcement flap 48 and retention tab 52 and the front wall panel 8, rear wall panel 10, top wall panel 12 and outside bottom wall panel 14*b*, respectively, of the blank 40 advantageously provide neat, dull right hand edges to the front wall 8, rear wall 10, top wall 12 and bottom wall 14 of the formed outer shell 4.

As previously described above, an aperture 54 (shown by broken lines in FIG. 3) may optionally be provided in the left side wall panel 16 of the blank 40 for forming the outer shell 4.

The blank 60 for forming the inner slide 6 of the container 2 shown in FIG. 4 has a front wall panel 22, a rear wall panel 24, a top wall panel 26, a bottom wall panel 28, an outer left side wall panel 30', an inner left side wall panel 30" and a right side wall panel 32, which when folded form the corresponding walls of the inner slide 6.

As shown in FIG. 4, the outer left side wall panel 30' and the inner left side wall panel 30" are connected to the rear wall panel 24 and the front wall panel 22, respectively, along longitudinal score lines. During erection of the inner slide 6 from the blank 60, the outer left side wall panel 30' and the inner left side wall panel 30" are folded through 90 degrees about the longitudinal score lines and the inner left side wall panel 30" is affixed to the inner surface of the outer left side wall panel 30'.

A pair of lower closure tabs 62, 64 are connected to the lower edges of the right side wall panel 32 and the outer left side wall panel 30', respectively, along transverse score lines and an upper closure tab 66 is connected to the upper edge of the right side wall panel 32 along a score line. During erection of the inner slide 6, the lower closure tabs 62 and 64 and the upper closure tab 66 are folded through 90 degrees about the score lines and affixed to the inner surface of the bottom wall panel 28 and the inner surface of the top wall panel 26, respectively.

The blank 60 also includes a bottom closure flap 68, which is connected to the rear edge of the bottom wall panel 28 along a transverse score line, and a top closure flap 70, which is connected to the rear edge of the top wall panel 26 along a transverse score line. During erection of the inner slide 6 from the blank 60, the bottom closure flap 68 and the top closure tab 70 are folded through 90 degrees about the transverse score lines and affixed to the inner surface of the rear wall panel 24.

A left side wall reinforcement flap 72 is connected to the upper edge of the outer left side wall panel 30' along a further transverse score line and a top wall reinforcement flap 74 is connected to the left hand edge top wall panel 26 along a score line. During erection of the inner slide 6, the left side wall reinforcement flap 72 and the top wall reinforcement flap 74 are folded through 180 degrees about the score lines and affixed to the inner surface of the inner left side wall panel 30" and the inner surface of the top wall panel 26, respectively. The fold line formed between the left side wall reinforcement flap 72 and the outer left side wall panel 30' and the fold line formed between the top wall reinforcement flap 74 and the top wall panel 26, respectively, advantageously provide a neat, dull upper edge to the left wall 30 and a neat, dull, left hand edge to the top wall 26 of the formed inner slide 6.

The blank 60 further comprises a bottom retention tab 76, which is connected to the left hand edge of the bottom wall panel 28 along a score line. During erection of the inner slide 6 from the blank 60, the bottom retention tab 76 is folded through 180 degrees about the score line so that it rests against the outer surface of the bottom wall panel 28.

The blank also comprises a first side retention flap 78, which is connected to the outer left side wall panel 30' along a longitudinal score line, and a second side retention flap 80, which is connected to the inner left side wall panel 30" along a longitudinal score line.

During erection of the inner slide 6 from the blank 60, the first side retention flap 78 is folded through 90 degrees about the longitudinal score line so that it rests against the outer surface of the front wall 22 of the formed inner slide 6. The second side retention flap 80 is folded through 90 degrees about the longitudinal score line and inserted through a cut or slit 82 provided along the longitudinal score line between the outer left side wall panel 30' and the rear wall panel 24, so that it rests against the outer surface of the rear 24 wall of the formed inner slide 6.

The first side retention flap 78 and the second side retention flap 80 are not affixed to the outer surface of the front wall panel 22 and the outer surface of the rear wall panel 24, respectively. Instead, the first side retention flap 78 and the second side retention flap 80 are biased against the front wall panel 22 and the rear wall panel 24, respectively, of the blank 60 due to the bending moment about the longitudinal score lines. The biasing ensures that the first side retention flap 78 and the second side retention flap 80 of the inner slide 6 interact with the front wall reinforcement flap 46 and the rear wall reinforcement flap 46, respectively, of the outer shell 4, as described further below, once the inner slide 6 is inserted into the outer shell 4, thereby helping to retain the inner slide 6 within the outer shell 4.

To form the container of cigarettes shown in FIGS. 1 and 2, a bundle of cigarettes is wrapped in an inner liner consisting of a folded sheet of metal foil or metallised paper in a conventional manner and the various panels, flaps and tabs of the one-piece laminar cardboard blanks 40, 60 shown in FIGS. 3 and 4 are folded and secured to one another to form the outer shell 4 and inner slide 6, respectively, of the container 2.

It will be appreciated that the precise order in which the various panels, flaps and tabs of the one-piece laminar cardboard blanks 40, 60 shown in FIGS. 3 and 4 are folded and secured to one another to form the outer shell 4 and inner slide 6, respectively, of the container 2 of FIGS. 1 and 2 may be varied depending upon, for example, the apparatus used to produce the container 2.

In use, as the inner slide 6 reaches the open position shown in FIG. 2, the outwardly folded retention tab 76 of the inner slide 6 engages the inwardly folded retention flap 52 of the outer shell 4, thereby advantageously preventing further slidable movement of the inner slide 6 relative to the outer shell 4 beyond the open position.

In addition, as the inner slide 6 reaches the open position shown in FIG. 2, the first side retention flap 78 and the second side retention flap 80 of the inner slide 6 engage the front wall reinforcement flap 46 and the rear wall reinforcement flap 46 of the outer shell 4 thereby advantageously also preventing further slidable movement of the inner slide 6 relative to the outer shell 4 beyond the open position.

The invention has been exemplified above with reference to a slide and shell container of cigarettes; it will be appreciated, however, that containers according to the invention may house other consumer goods.

The invention claimed is:

1. A slide and shell container comprising:

an outer shell having a front wall and an opposed rear wall, a top wall and an opposed bottom wall, which connect the front wall and the rear wall along upper and lower edges respectively, and a left side wall, which connects the front wall, the rear wall, the top wall and the bottom wall, and defines an open-sided receptacle, and a first access opening, an inner slide having a front wall and an opposed rear wall, a top wall and an opposed bottom wall, which connect the front wall and the rear wall along upper and lower edges respectively, a left side wall, which connects the left side edges of the front wall, rear wall and bottom wall, and an opposed right side wall, which connects right side edges of the front wall, the rear wall, the top wall and the bottom wall, and a second access opening, the inner slide being mounted within the open-sided receptacle of the outer shell for slidable movement relative thereto between a closed position, in which the second access opening is occluded by the outer shell and the interior of the inner slide is inaccessible, and an open position, in which the second access opening is substantially aligned with the first access opening such that the interior of the inner slide is accessible through the first and second access openings, a retention system comprised of an inwardly folded retention flap pivotably mounted on the outer shell and an outwardly folded retention tab mounted on the inner slide, wherein as the inner slide reaches the open position, the outwardly folded retention tab engages the inwardly folded retention flap preventing further slidable movement of the inner slide relative to the outer shell beyond the open position, a first side retention flap and a second side retention flap on the inner slide, and a front wall reinforcement flap and a rear wall reinforcement flap on the outer shell, and wherein as the inner slide reaches the open position, the first side retention flap and the second side retention flap of the inner slide engage the front wall reinforcement flap and the rear wall reinforcement flap of the outer shell thereby preventing slidable movement of the inner slide relative to the outer shell beyond the open position, and an outer left side wall and an inner left side wall, which are connected to the front wall and the rear wall, respectively, and wherein the first side retention flap and the second side retention flap are connected to the outer left side wall and the inner left side wall, respectively.

2. A slide and shell container according to claim 1 wherein the first access opening is located in the top wall of the outer shell and the second access opening is located in the top wall of the inner slide.

3. A slide and shell container according to claim 1 wherein at least one cut-out is provided along a free edge of the outer shell.

4. A slide and shell container according to claim 1 wherein an aperture is provided in the left side wall of the outer shell perpendicular to the direction of slidable movement of the inner slide relative to the outer shell in order to facilitate slidable movement of the inner slide from the closed position to the open position.

5. A slide and shell container according to claim 1 wherein the outer shell is formed from a one-piece blank.

6. A slide and shell container according to claim 1 wherein the inner slide is formed from a one-piece blank.

7. A slide and shell container according to claim 1 containing smoking articles.

8. A slide and shell container according to claim 1 wherein the inner slide houses a plurality of cigarettes.

9. A slide and shell container according to claim 5 wherein the blank comprises a top wall panel, a front wall panel foldably attached to the top wall panel, a rear wall panel foldably attached to the top wall panel opposite the front wall panel, and said first access opening extending across the top wall panel into the front wall panel and the rear wall panel.

10. A slide and shell container according to claim 1 wherein the inwardly folded retention flap is connected to a right hand edge of the bottom wall of the outer shell, and the outwardly folded retention tab is connected to a left hand edge of the bottom wall of the inner slide.

11. A slide and shell container according to claim 1 further comprising a pair of opposed semi-circular cut-outs, which are provided along right-hand longitudinal free edges of the front wall and the rear wall of the outer shell and are distant from the left side wall.

12. A slide and shell container according to claim 1 wherein the front wall reinforcement flap and the rear wall reinforcement flap are connected to the front wall and the rear wall, respectively.

* * * * *